US011365563B2

(12) United States Patent
Ginter et al.

(10) Patent No.: US 11,365,563 B2
(45) Date of Patent: Jun. 21, 2022

(54) EXIT DEVICE DOGGING OPERATOR

(71) Applicant: BEST ACCESS SOLUTIONS, INC., Indianapolis, IN (US)

(72) Inventors: Mark Ginter, Noblesville, IN (US); Michael E. McCoy, Indianapolis, IN (US); Gary W. Davidson, Indianapolis, IN (US)

(73) Assignee: dormakaba USA Inc., Indianapolis, IN (US)

( * ) Notice: Subject to any disclaimer, the term of this patent is extended or adjusted under 35 U.S.C. 154(b) by 614 days.

(21) Appl. No.: 16/089,591

(22) PCT Filed: Mar. 31, 2017

(86) PCT No.: PCT/US2017/025348
§ 371 (c)(1),
(2) Date: Sep. 28, 2018

(87) PCT Pub. No.: WO2017/173253
PCT Pub. Date: Oct. 5, 2017

(65) Prior Publication Data

US 2019/0093393 A1 Mar. 28, 2019

Related U.S. Application Data

(60) Provisional application No. 62/316,295, filed on Mar. 31, 2016.

(51) Int. Cl.
*E05B 65/10* (2006.01)
*E05B 37/00* (2006.01)
(Continued)

(52) U.S. Cl.
CPC ..... *E05B 65/1093* (2013.01); *E05B 37/00* (2013.01); *E05B 63/18* (2013.01);
(Continued)

(58) Field of Classification Search
CPC ..... E05B 65/1053; E05B 65/1093; E05B 65/1046; E05B 37/00; E05B 37/0034;
(Continued)

(56) References Cited

U.S. PATENT DOCUMENTS 3,099,150 A * 7/1963 Check ..... E05B 37/166 70/313
5,412,961 A * 5/1995 Cain ..... E05B 63/0065 292/92
5,490,696 A * 2/1996 Hutson ..... E05B 65/1073 292/139
(Continued)

FOREIGN PATENT DOCUMENTS

GB 2276910 A 10/1994
JP 06-074003 U 10/1994
JP 2002-357029 A 12/2002

OTHER PUBLICATIONS

International Preliminary Report on Patentability received for PCT Patent Application No. PCT/US2017/025348, dated Oct. 11, 2018, 9 pages.
International Search Report and Written Opinion received for PCT Patent Application No. PCT/US2017/025348, dated Jun. 28, 2017, 9 pages.

*Primary Examiner* — Mark A Williams
(74) *Attorney, Agent, or Firm* — Faegre Drinker Biddle & Reath LLP

(57) ABSTRACT

An exit device for a door includes an elongate housing, a latch, a touch bar assembly, a panel, and a dogging assembly. The elongate housing is configured to be mounted to the door. The touch bar assembly is attached to the elongate housing. The touch bar assembly includes a touch bar that is movable relative to the elongate housing and has a linkage that operably connects the touch bar to the latch. The panel is connected to the elongate housing. The dogging assembly has a combination lock dogging operator and a dogging
(Continued)

mechanism. The dogging mechanism is rotatably coupled to the elongate housing. The combination lock dogging operator is mounted to the panel, and is drivably engaged with the dogging mechanism.

22 Claims, 8 Drawing Sheets

(51) Int. Cl.
*E05B 63/18* (2006.01)
*E05C 3/04* (2006.01)

(52) U.S. Cl.
CPC ..... *E05B 65/1046* (2013.01); *E05B 65/1053* (2013.01); *E05C 3/042* (2013.01); *E05Y 2900/132* (2013.01)

(58) Field of Classification Search
CPC ..... E05B 63/18; Y10T 292/0908; Y10T 70/5159; Y10T 70/5788; Y10T 292/0822; Y10T 292/0975; Y10T 70/7141; Y10T 70/7147; Y10S 292/65; E05C 19/003; E05C 3/042; E05Y 2900/132
See application file for complete search history.

(56) References Cited

U.S. PATENT DOCUMENTS 5,947,534 A * 9/1999 Zarzycki, Jr. ..... E05B 65/1073 292/92
6,820,905 B1 * 11/2004 Haeck ..... E05B 65/1013 292/223
2001/0005996 A1 * 7/2001 Haeck ..... E05B 65/104 70/92
2005/0104381 A1 5/2005 Whitaker et al.
2008/0115546 A1 * 5/2008 Hu ..... E05B 37/16 70/214
2008/0236211 A1 * 10/2008 Ma ..... E05B 65/52 70/74
2013/0001961 A1 * 1/2013 Shen ..... E05B 65/1053 292/223
2013/0298616 A1 11/2013 Ullrich et al.
2014/0109479 A1 * 4/2014 Morstatt ..... E05B 65/1093 49/32
2015/0176308 A1 * 6/2015 Talpe ..... E05B 3/00 70/214
2016/0083978 A1 3/2016 Dayanikli et al.
2016/0115719 A1 * 4/2016 Coleman ..... E05B 17/002 292/195
2016/0230423 A1 * 8/2016 Lehner, Jr. ..... E05B 65/1093

* cited by examiner

EXIT DEVICE DOGGING OPERATOR

CROSS-REFERENCE TO RELATED APPLICATIONS

This application is a U.S. National Phase Patent Application based on International Application No. PCT/US2017/025348 filed Mar. 31, 2017, which claims the benefit of U.S. Provisional Patent Application Ser. No. 62/316,295 filed Mar. 31, 2016, each of which is expressly incorporated by reference herein in its entirety as if each were incorporated by reference herein individually.

TECHNICAL FIELD

The present invention relates to door operating devices, and, more particularly, to an exit device having dogging using a combination lock.

BACKGROUND ART

FIG. 1 (prior art) shows one version of an Apex 2000 series exit device 10 available from BEST Access Solutions, Inc. located in Indianapolis, Ind. Exit device 10 includes an elongate housing 12 to which a touch bar 14 is movably attached. Elongate housing 12 is configured to be mounted to an inside surface of a door (not shown). Touch bar 14 is operably connected by a linkage to a latch 16 (sometimes also referred to in the art as a latch bolt) that is configured to engage a corresponding strike located on a door frame (not shown). By depressing touch bar 14 relative to elongate housing 12, the latch 16 is retracted, and the door may be opened from the inside of a room, thus facilitating egress of a person through the door. An exterior pull grip 18 may optionally be installed on the exterior of the door, which in some implementations may be in the form of a lockable lever operably coupled to latch 16.

In order to facilitate both free ingress and egress through the door, exit device 10 includes a dogging mechanism which is configured to selectively latch touch bar 14 in the depressed state, and which in turn holds latch 16 in the retracted position. As used herein, "dogging", and variations thereof, is the use of a mechanical device to hold the latch in a retracted position for non-fire rated applications.

As a matter of security, exit device 10 is both dogged and un-dogged using a removable dogging key. The removable dogging key may be in the form of a hex tool, or alternatively, a standard key. Thus, in the present state of the art, the removable dogging key is necessary to both place the dogging mechanism in the dogged state so as to hold latch 16 in the retracted position, and to return to the un-dogged state from the dogged state.

A potential limitation of exit device 10 is that the removable dogging key may not be readily available to the operator charged with dogging and un-dogging exit device 10. For example, the operator may simply not have the removable dogging key on their person, or the removable dogging key may have been misplaced. Also, it has been observed that a lack of knowledge of the proper use of the removable dogging key may result in damage to exit device 10.

What is needed in the art is an exit device configured to retain the security of using a lockable dogging mechanism, but which also provides for the convenience of an immediate change of the exit device state, e.g., from un-dogged to dogged, or vice-versa, and which reduces the risk of periodic damage that occurs from improper dogging of the exit device. The present invention provides such a solution.

SUMMARY OF INVENTION

The invention, in one form, is directed to an exit device for a door. The exit device includes an elongate housing, a latch, a touch bar assembly, a panel, and a dogging assembly. The elongate housing is configured to be mounted to the door. The touch bar assembly is attached to the elongate housing. The touch bar assembly includes a touch bar that is movable relative to the elongate housing and has a linkage that operably connects the touch bar to the latch. The panel is connected to the elongate housing. The dogging assembly has a combination lock dogging operator and a dogging mechanism. The dogging mechanism is rotatably coupled to the elongate housing. The combination lock dogging operator is mounted to the panel, and is drivably engaged with the dogging mechanism.

A method for operating the exit device includes operating a combination lock of the combination lock dogging operator to achieve an unlocked state; and operating a combination lock hub of the combination lock dogging operator to selectively change the operating state of the dogging mechanism from an un-dogged state to a dogged state or from the dogged state to the un-dogged state.

An advantage of the present invention is that the exit device may be dogged, or un-dogged, locally by an authorized person without the need to retrieve a dogging key from a remote location.

Another advantage of the present invention is that there is no insertion of a removable dogging key into the exit device, thus reducing the possibility of damage to the dogging mechanism by using an improper dogging or un-dogging technique.

BRIEF DESCRIPTION OF DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DESCRIPTION OF EMBODIMENTS

Figure 1:
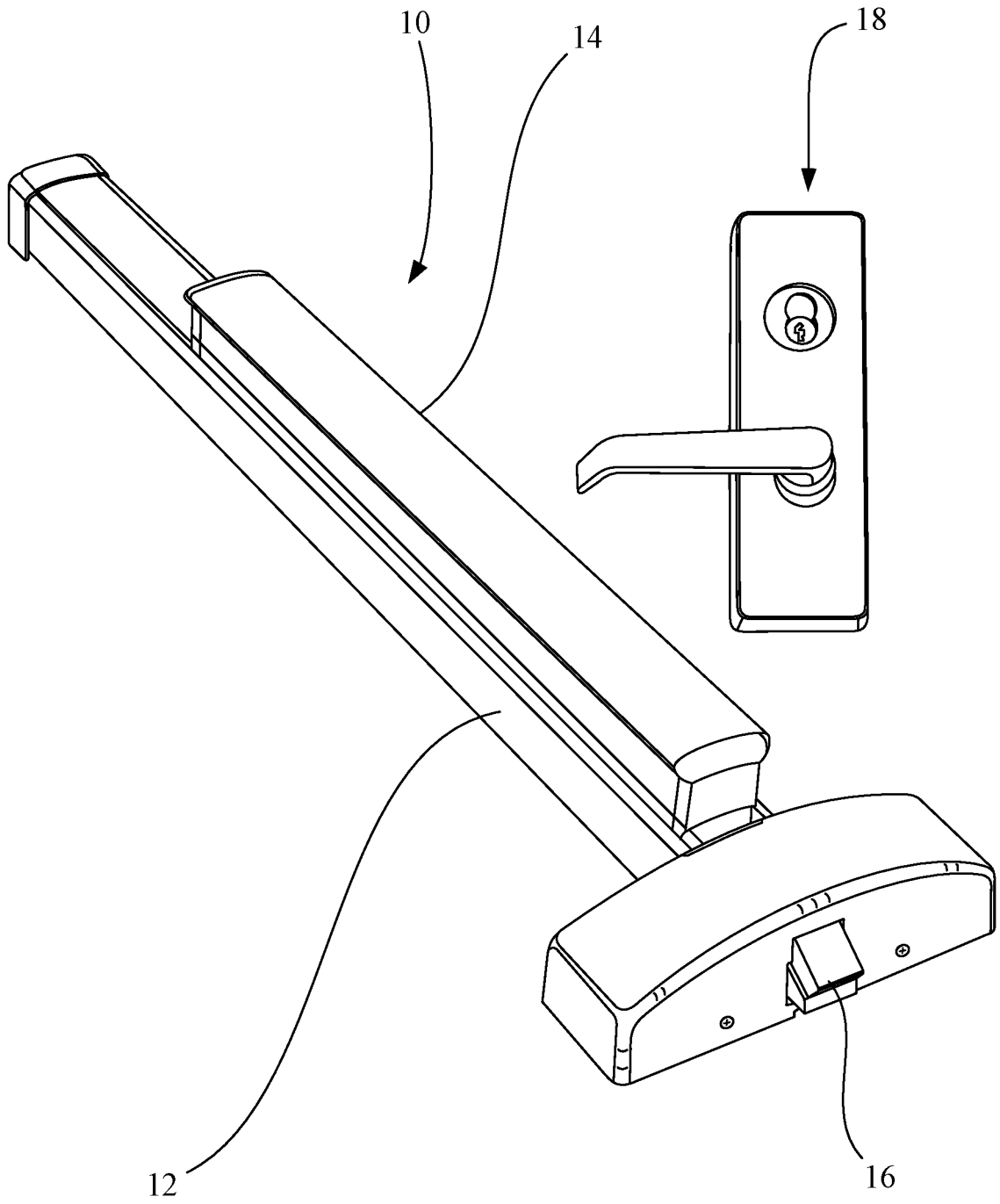
Fig. 1 Prior Art
FIG. 1 is a perspective view of a prior art exit device and optional exterior pull grip.

Referring now to the drawings, and particularly to FIGS. 2-10, there is shown an exit device 20 in accordance with an aspect of the present invention.

Figure 2:
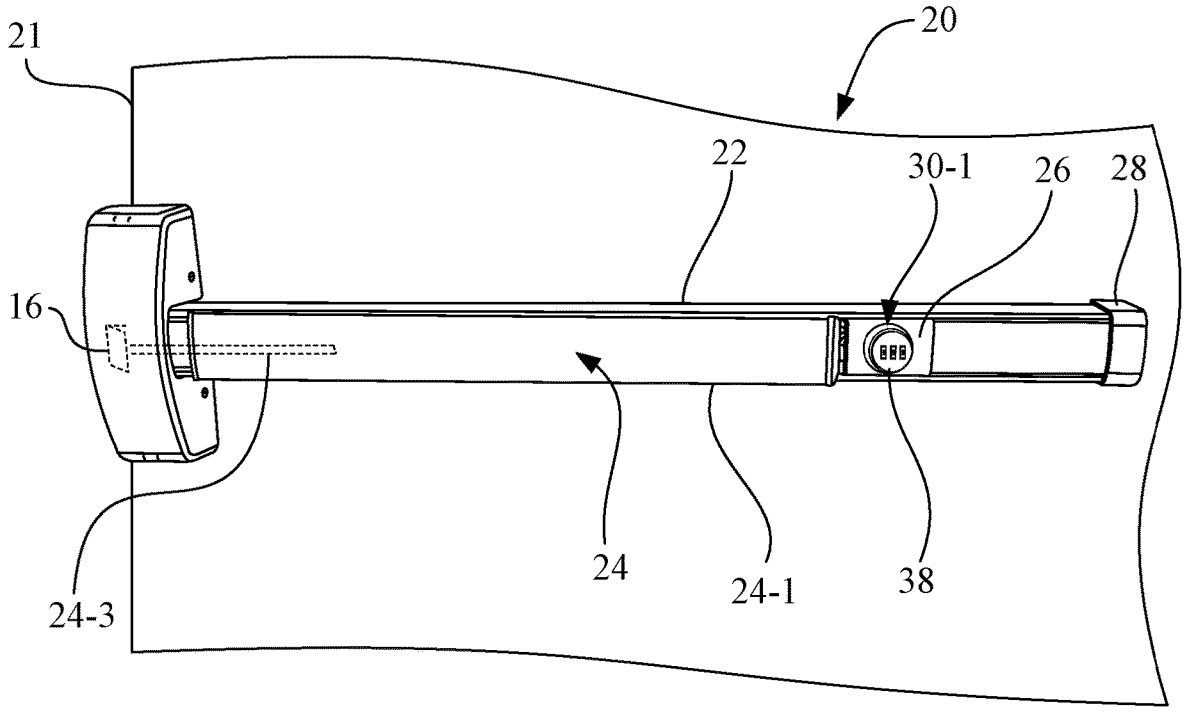
FIG. 2 is a side view of an exit device of the present invention having a combination lock dogging operator, and shown in a left-hand configuration.
Figure 3:
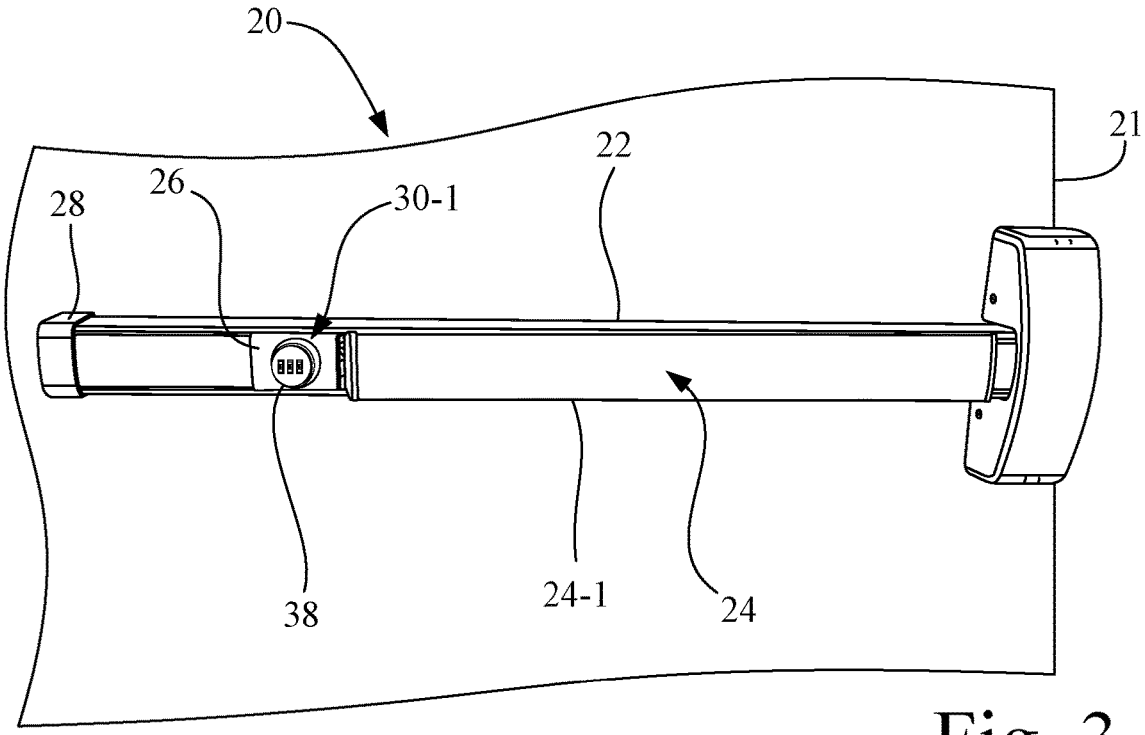
FIG. 3 is a side view of the exit device of FIG. 2 having the combination lock dogging operator, and is shown in a right-hand configuration.

Referring to FIGS. 2 and 3, exit device 20 is mounted to a door 21. Exit device 20 includes an elongate housing 22, a touch bar assembly 24, a slide panel 26, an end cap 28, and a dogging assembly 30 (see FIG. 5) having combination lock dogging operator 30-1. Elongate housing 22 is configured to be mounted to an inside surface of door 21.

Touch bar assembly 24 is attached to elongate housing 22, and includes a touch bar 24-1 that is movable relative to elongate housing 22. Touch bar assembly 24 includes a linkage 24-3 that operably connects touch bar 24-1 to a latch, such as a horizontal latch 16 shown in FIGS. 1 and 2, or alternatively, to a vertical latch mechanism, in a conventional manner as is well known in the art. By depressing touch bar 24-1 relative to elongate housing 22, the latch 16 is retracted, and the door may be opened from the inside of a room, thus facilitating egress of a person through the door. As used herein, the term "assembly" refers to structure having two or more components that are connected.

Figure 4:
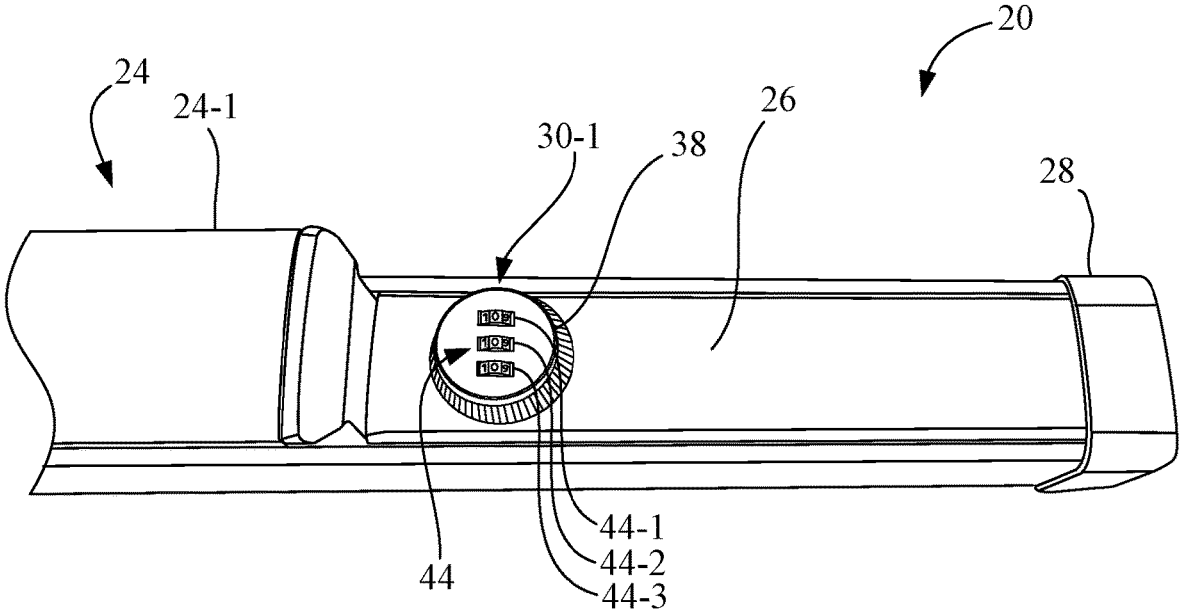
FIG. 4 is an enlarged view of a portion of the exit device of FIG. 2 having the combination lock dogging operator.
Figure 5:
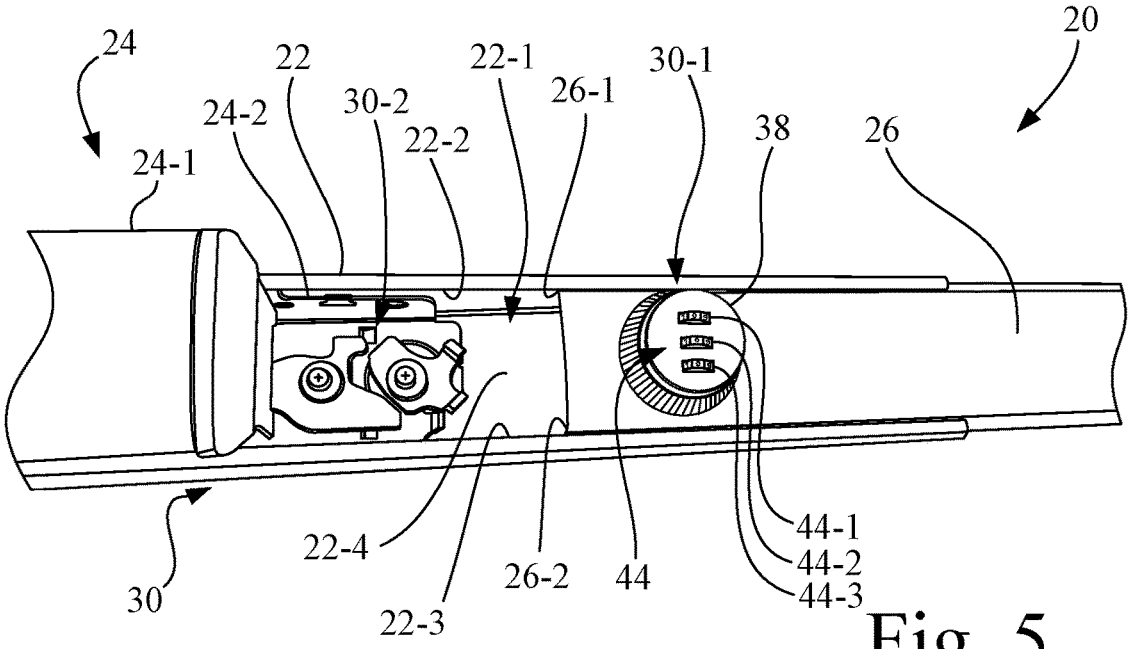
FIG. 5 is an enlarged view of a portion of the exit device of FIG. 2 having a slide panel that mounts the combination lock dogging operator, which is moved to the right to expose the dogging mechanism.

Referring also to FIGS. 4 and 5, slide panel 26 is slidably connected to elongate housing 22. FIG. 4 shows slide panel 26 in a closed position and FIG. 5 shows slide panel 26 in an open position. Slide panel 26 is configured to mount combination lock dogging operator 30-1, so as to form a slide assembly. Elongate housing 22 is configured to slidably receive slide panel 26, such that when end cap 28 is removed from elongate housing 22, slide panel 26 may be moved in a longitudinal direction relative to elongate housing 22. In particular, as shown in FIG. 5, elongate housing 22 defines a longitudinal U-shaped channel 22-1 that includes a pair of opposed upper rails 22-2, 22-3 and a base wall 22-4. Slide panel 26 includes a pair of opposed lower rails 26-1, 26-2 sized and spaced to be slidably received by the pair of opposed upper rails 22-2, 22-3 of elongate housing 22.

As shown in FIG. 5, with slide panel 26 in the open position, a dogging mechanism 30-2 of dogging assembly 30 is exposed, and more particularly, the combination lock dogging operator 30-1 mounted to slide panel 26 is disengaged from dogging mechanism 30-2. Conversely, when slide panel 26 is in the closed position depicted in FIG. 4, combination lock dogging operator 30-1 is drivably engaged with dogging mechanism 30-2.

Figure 6:
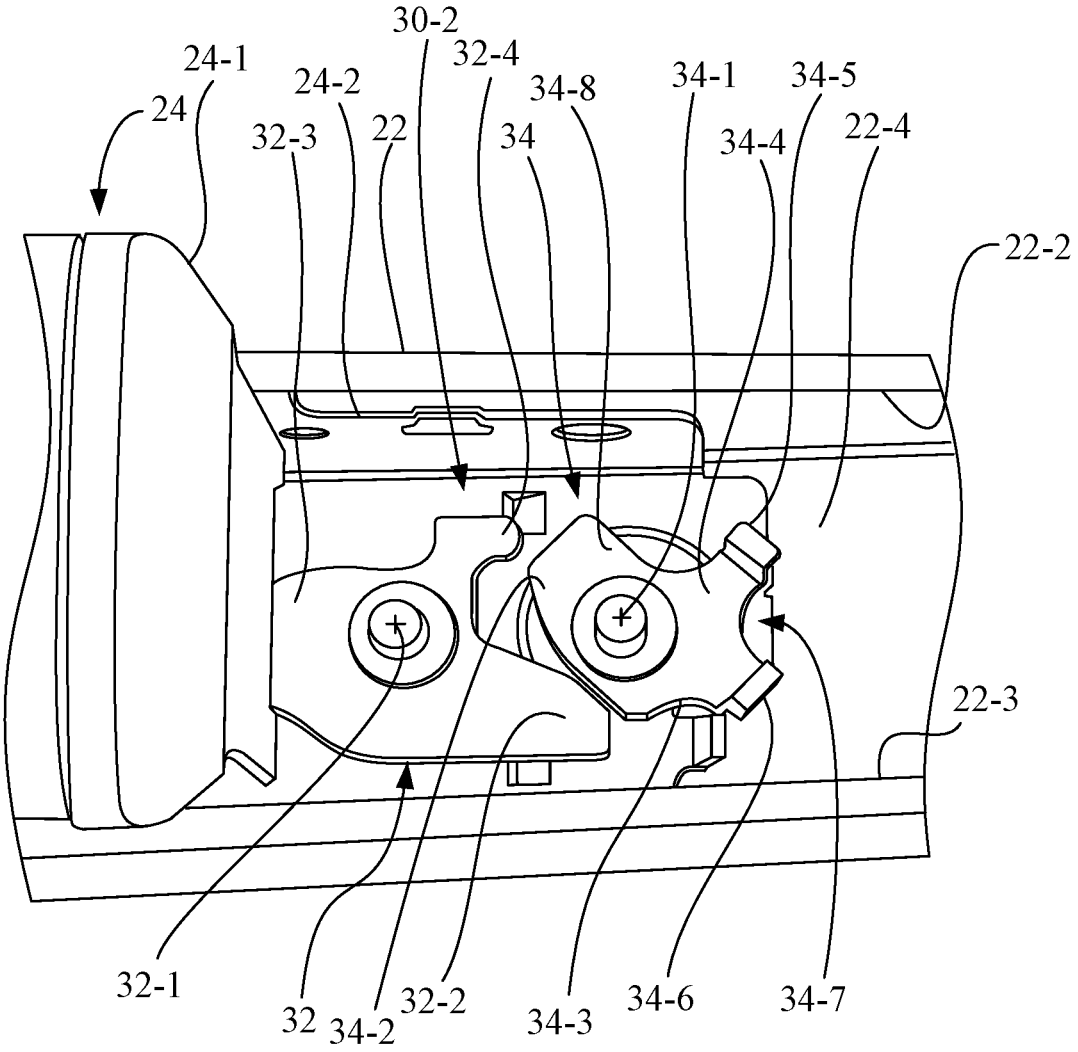
FIG. 6 is a further enlarged view of the dogging mechanism of FIG. 5, with the dogging mechanism in the un-dogged state.
Figure 7:
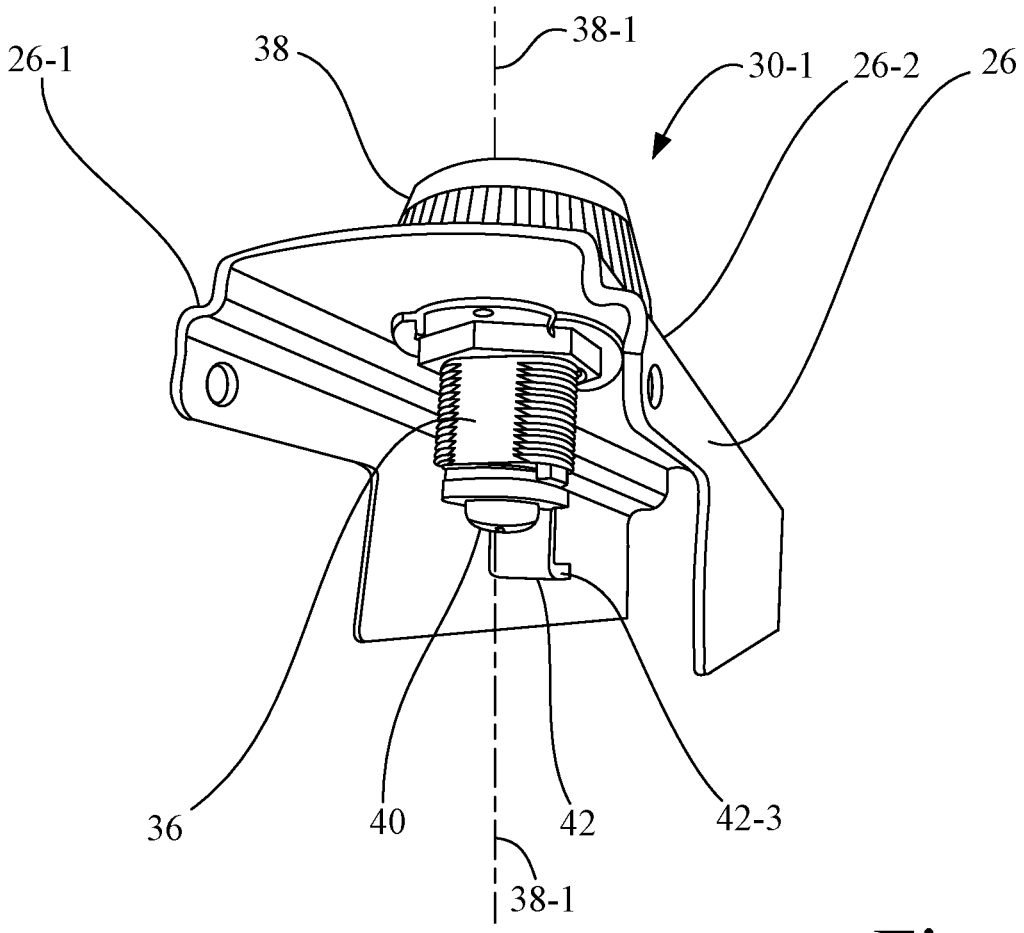
FIG. 7 is an interior end view of the slide panel that mounts the combination lock dogging operator, and shows the dogging arm of the combination lock dogging operator in the un-dogged state.
Figure 8:
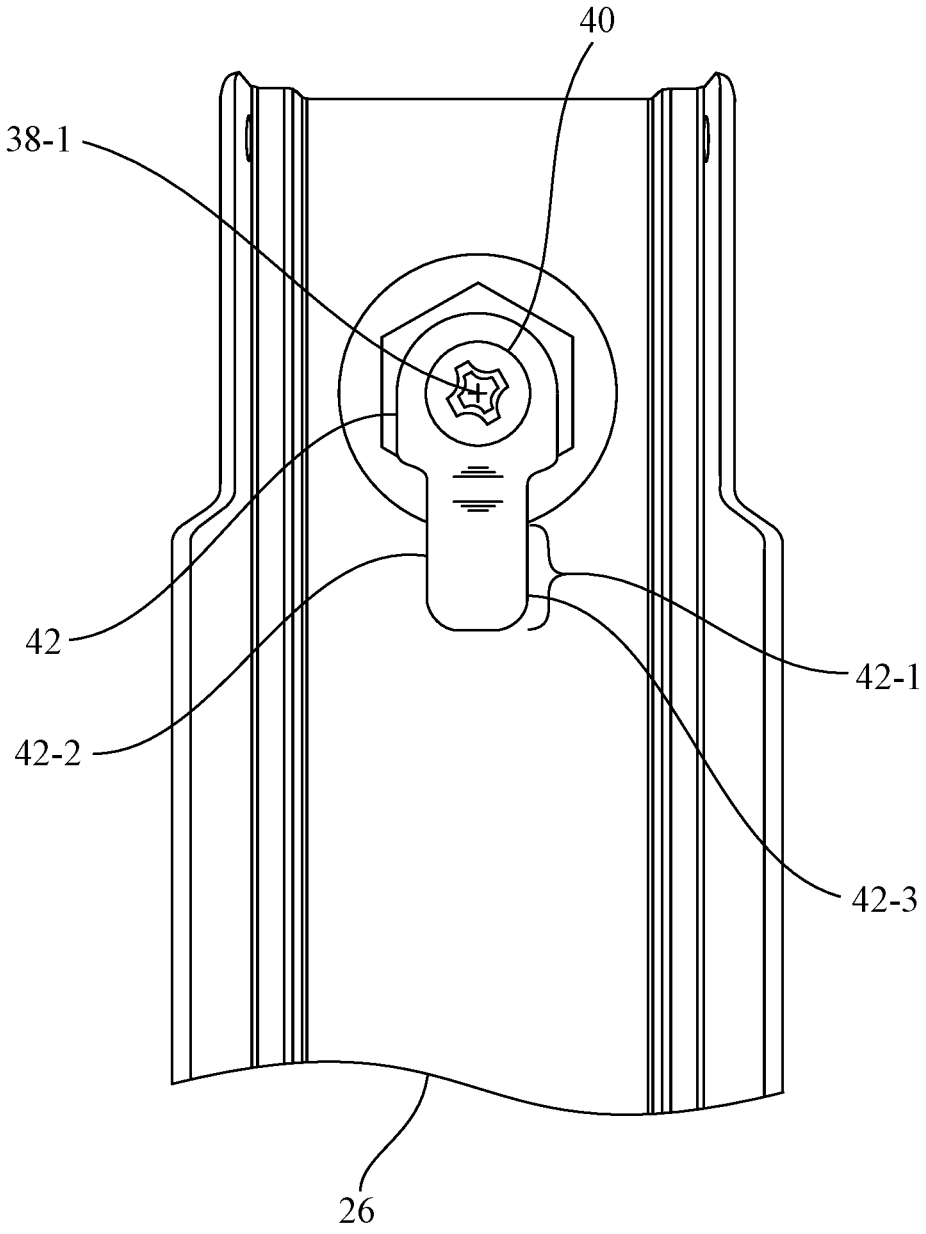
FIG. 8 is a back side view of the slide panel and combination lock dogging operator as depicted in FIG. 7, showing the dogging arm of the combination lock dogging operator in the un-dogged state.
Figure 9:
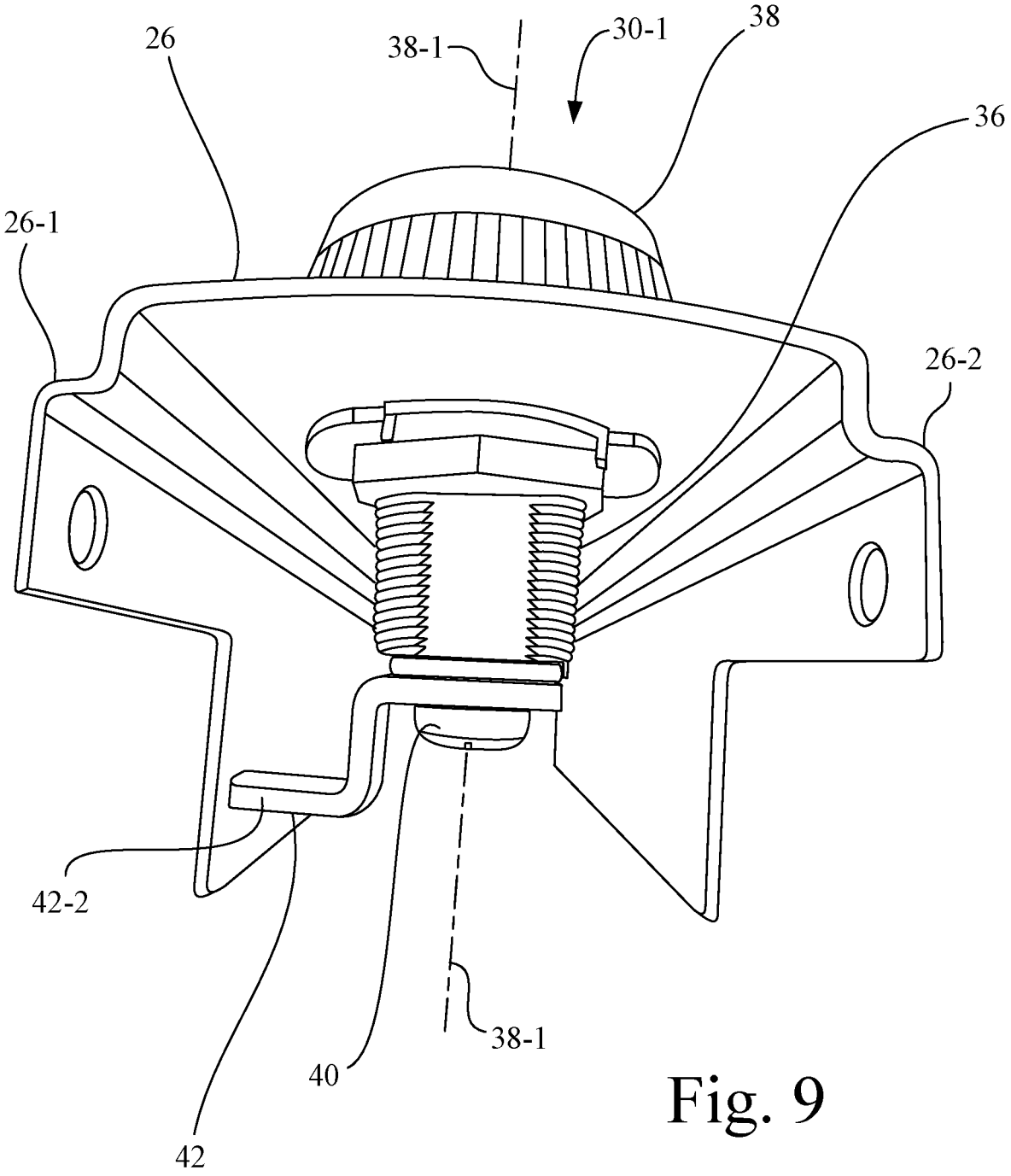
FIG. 9 is an interior end view of the slide panel that mounts the combination lock dogging operator, and shows the dogging arm of the combination lock dogging operator in the dogged state.

Referring also to FIG. 6, touch bar assembly 24 includes a base mount 24-2. Base mount 24-2 is attached to base wall 22-4 of longitudinal U-shaped channel 22-1 of elongate housing 22. In the present embodiment, dogging mechanism 30-2 is rotatably mounted to base mount 24-2 of touch bar assembly 24, and thus, also is rotatably coupled to base wall 22-4 of elongate housing 22.

Dogging mechanism 30-2 includes a touch bar engagement plate 32 and a dogging plate 34.

Touch bar engagement plate 32 includes a rotational axis 32-1, a cam 32-2, a touch bar engagement arm 32-3, and cam 32-4, with cam 32-4 being angularly separated from cam 32-2. Each of cam 32-2 and 32-4 is located on the opposite side of rotational axis 32-1 from touch bar engagement arm 32-3. In some implementations, touch bar engagement plate 32 may be biased, e.g., by a spring, to the un-dogged position shown in FIG. 6.

Dogging plate 34 includes a rotational axis 34-1, a dogging cam 34-2, an operator engagement arm 34-3, and a dogging cam 34-8, with dogging cams 34-2, 34-8 being located on an opposite side of rotational axis 34-1 from operator engagement arm 34-3. Operator engagement arm 34-3 of dogging plate 34 includes an offset portion 34-4 and a pair of protrusions 34-5, 34-6. The pair of protrusions 34-5, 34-6 are oriented to be substantially perpendicular to offset portion 34-4, and are spaced apart to define an engagement opening 34-7 between protrusion 34-5 and protrusion 34-6. As used herein, the term "substantially perpendicular" defines a range of plus or minus 5 degrees from perpendicular.

In the orientation of components shown in FIG. 6, dogging mechanism 30-2 is in its un-dogged state. Touch bar assembly 24 is configured to prevent operation of dogging mechanism 30-2 to the dogged state until touch bar 24-1 is depressed relative to elongate housing 22. With touch bar 24-1 in the depressed position, dogging mechanism 30-2 may be positioned in its dogged state by rotating dogging plate 34 counterclockwise about rotational axis 34-1, wherein dogging cam 34-2 of dogging plate 34 engages cam 32-2 of touch bar engagement plate 32, thereby rotating touch bar engagement plate 32 clockwise about rotational axis 32-1. The rotation of touch bar engagement plate 32 clockwise about rotational axis 32-1 causes an angular rotation of touch bar engagement arm 32-3 to engage a slot, or other opening, in touch bar 24-1 or its depression linkage, so as to lock touch bar 24-1 down in the depressed position. With touch bar 24-1 in the depressed position, the associated latch, e.g., latch 16 of FIG. 1, is in the retracted position.

Referring now also to FIGS. 7-10, combination lock dogging operator 30-1 includes a stationary base 36, a combination lock hub 38, a rotatable shaft 40, and a dogging arm 42. Combination lock hub 38 is rotatably attached to stationary base 36. A threaded portion of stationary base 36 is received through a hole in slide panel 26, and a hex nut is used to attach stationary base 36 of combination lock dogging operator 30-1 to slide panel 26. Combination lock hub 38 is connected to rotatable shaft 40. Dogging arm 42 is fixedly attached to rotatable shaft 40 for rotation therewith.

In the present embodiment, combination lock hub 38 includes a combination lock 44 that may be in the form of a mechanical combination lock having a plurality of combination lock dial tumblers 44-1, 44-2, 44-3, as shown in FIGS. 2, 3, and 4. Alternatively, however, it is contemplated that combination lock 44 may have other mechanical locking operator configurations, such as for example, a combination lock having a single axial rotating dial for activating lock tumblers, or a combination lock having a plurality of pushbuttons for operating lock tumblers.

Combination lock hub 38, rotatable shaft 40, and dogging arm 42 are configured for unitary rotation, e.g., approximately one-quarter turn, about a rotational axis 38-1 relative to stationary base 36 when combination lock 44 is in an unlocked state, i.e., when the combination lock tumblers of combination lock 44 are in an unlocked position. As used herein, the term "about one-quarter turn" is a rotational range of 90 degrees, plus or minus 5 degrees. When combination lock 44 is in a locked state, i.e., the combination lock tumblers of combination lock 44 are in a locked position, the combination lock hub 38, and in turn rotatable shaft 40 and dogging arm 42, are blocked from rotation. Dogging arm 42 extends in a direction that is substantially perpendicular to rotational axis 38-1, and is rotatable in a range of 90 degrees, plus or minus 5 degrees, from the un-dogged orientation shown in FIGS. 7 and 8, to the dogged orientation shown in FIGS. 9 and 10.

With both the combination lock dogging operator 30-1 and dogging mechanism 30-2 in the un-dogged position, as shown in FIGS. 5-8, slide panel 26 may be moved to the closed position depicted in FIG. 4. During movement of slide panel 26 from the open position depicted in FIG. 5 to the closed position depicted in FIG. 4, dogging arm 42 of combination lock dogging operator 30-1 freely passes between the pair of protrusions 34-5, 34-6 of dogging plate 34 of dogging mechanism 30-2. Thus, when slide panel 26 is in the closed position depicted in FIG. 4, a distal portion 42-1 of dogging arm 42 (see FIGS. 7 and 8) of combination lock dogging operator 30-1 is positioned between the pair of protrusions 34-5, 34-6 of dogging plate 34 of dogging mechanism 30-2 (see FIG. 6). Accordingly, an engagement edge 42-2 of distal portion 42-1 of dogging arm 42 is positioned to engage protrusion 34-5 of dogging plate 34 of dogging mechanism 30-2 upon rotation of combination lock hub 38 in the counterclockwise direction, and an engagement edge 42-3 of distal portion 42-1 of dogging arm 42 is positioned to engage protrusion 34-6 of dogging plate 34 of dogging mechanism 30-2 upon rotation of combination lock hub 38 in the clockwise direction.

Touch bar assembly 24 is configured to prevent a change of state of dogging assembly 30 from the un-dogged state to the dogged state until touch bar 24-1 is depressed relative to elongate housing 22. This helps prevent periodic damage that occurs from improper dogging. With touch bar 24-1 depressed to the depressed position, dogging assembly 30 may be operated to achieve the dogged state. In a direction facing combination lock hub 38 in the orientation shown in FIG. 4, a counterclockwise rotation of combination lock hub 38 effects a corresponding rotation of rotatable shaft 40 and dogging arm 42 about rotational axis 38-1 to effect a state change of dogging assembly 30 from the un-dogged state to the dogged state.

Figure 10:
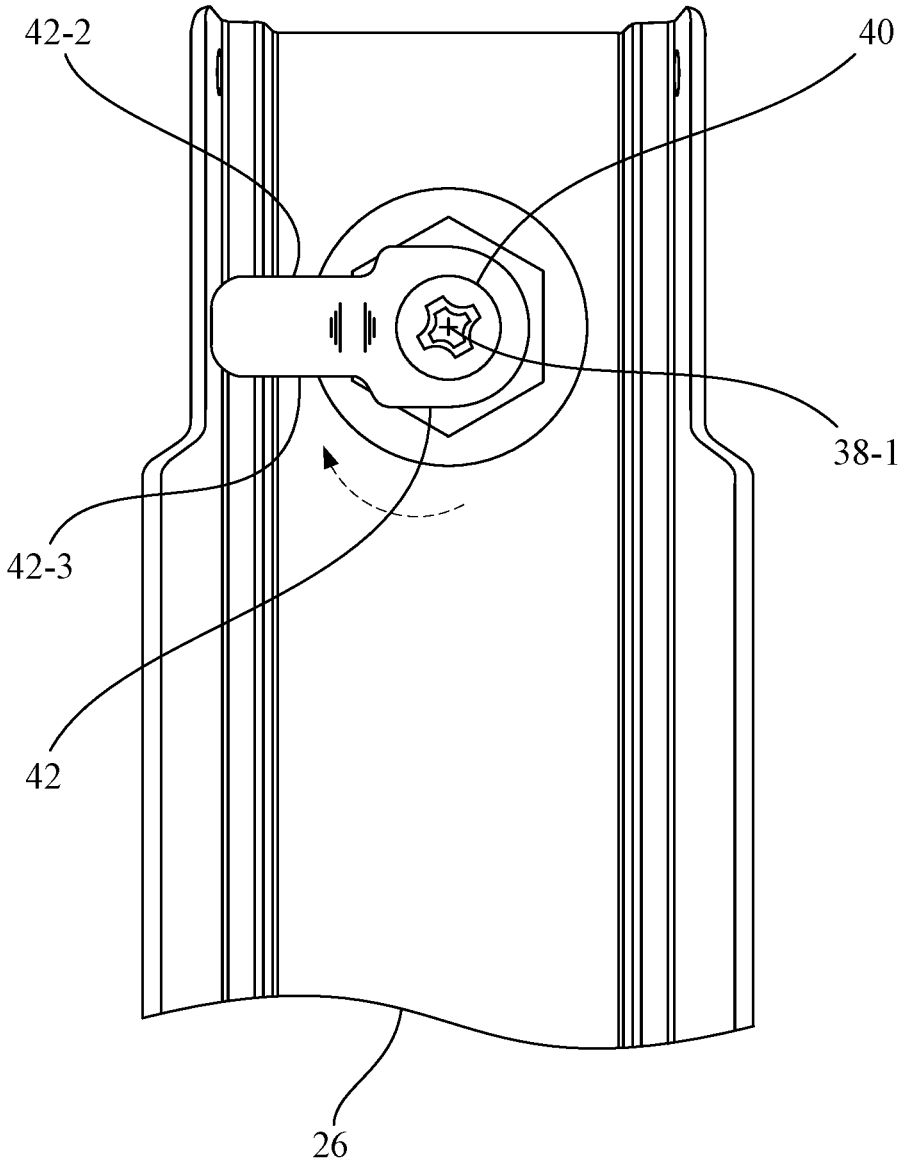
FIG. 10 is a back side view of the slide panel and combination lock dogging operator as depicted in FIG. 9, showing the dogging arm of the combination lock dogging operator in the dogged state.

In particular, referring also to FIGS. 5-10, the counterclockwise rotation of combination lock hub 38, and in turn rotatable shaft 40 and dogging arm 42, about rotational axis 38-1 causes engagement edge 42-2 of distal portion 42-1 of dogging arm 42 to engage protrusion 34-5 of dogging plate 34 of dogging mechanism 30-2, which in turn rotates dogging plate 34 counterclockwise about rotational axis 34-1 (see FIGS. 5 and 6) from the un-dogged state as shown, to the dogged state. It is noted that the dashed-curved arrow shown in FIG. 10 depicts the counterclockwise rotation of combination lock hub 38 as viewed from the outside of exit device 20. The counterclockwise rotation of dogging plate 34 about rotational axis 34-1 causes dogging cam 34-2 of dogging plate 34 to engage cam 32-2 of touch bar engagement plate 32, thereby rotating touch bar engagement plate 32 clockwise about rotational axis 32-1. The rotation of touch bar engagement plate 32 clockwise about rotational axis 32-1 causes an angular rotation of touch bar engagement arm 32-3 to engage a slot, or other opening, in touch bar 24-1 or its depression linkage so as to lock touch bar 24-1 down in the depressed position, so as to achieve the dogged state.

Conversely, un-dogging is achieved by a clockwise rotation of combination lock hub 38, and in turn rotatable shaft 40 and dogging arm 42, about rotational axis 38-1, which causes engagement edge 42-3 of distal portion 42-1 of dogging arm 42 (see FIGS. 8-10) to engage protrusion 34-6 of dogging plate 34 of dogging mechanism 30-2, which in turn rotates dogging plate 34 clockwise about rotational axis 34-1 (see FIGS. 5 and 6) from the dogged state, to the un-dogged state. Again, it is noted that the dashed-curved arrow shown in FIG. 10 depicts a counterclockwise rotational direction of combination lock hub 38 as viewed from the outside of exit device 20. The clockwise rotation of dogging plate 34 about rotational axis 34-1 causes dogging cam 34-8 of dogging plate 34 to engage cam 32-4 of touch bar engagement plate 32, thereby rotating touch bar engagement plate 32 counterclockwise about rotational axis 32-1. The rotation of touch bar engagement plate 32 counterclockwise about rotational axis 32-1 causes an angular rotation of touch bar engagement arm 32-3 to disengage the slot, or other opening, in touch bar 24-1 or its depression linkage so as to release touch bar 24-1 from the depressed position, so as to achieve the un-dogged state.

Since the slide assembly is formed by attaching combination lock dogging operator 30-1 to slide panel 26, the slide assembly can be quickly and easily changed out by placing dogging assembly 30 in the un-dogged state, removing end cap 28, sliding the present slide assembly out of elongate housing 12, and then reversing the procedure while using a different slide assembly.

It is contemplated that the combination lock dogging operator 30-1 may have other mechanical locking configurations for the combination lock 44 incorporated into combination lock hub 38 to provide security for the dogging operation other than the plurality of combination lock tumblers, e.g., dial tumblers 44-1, 44-2, 44-3, as described in the embodiment above, such as a combination lock having a single axial rotating dial or a combination lock having pushbutton operators for operating lock tumblers. Also, it is contemplated that combination lock 44 may be in the form of an electromechanical combination lock that may be incorporated into combination lock hub 38, e.g., as a substitution for a mechanical combination lock, to provide security for the dogging operation, such as an electronic lock having pushbutton code entry.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An exit device for a door, the exit device comprising:

an elongate housing configured to be mounted to the door;

a latch having an extended state and a retracted state;

a touch bar assembly attached to the elongate housing, the touch bar assembly including a touch bar that is movable relative to the elongate housing, and the touch bar assembly having a linkage that operably connects the touch bar to the latch to position the latch in the retracted state;

a panel slidably connected to the elongate housing; and a dogging assembly having a lock dogging operator and a dogging mechanism, the dogging mechanism being rotatably coupled to the elongate housing, and the lock dogging operator being mountable carried by the panel, the panel along with the lock dogging operator are configured to be slidable from a first position on the elongate housing wherein the lock dogging operator is drivably engaged with the dogging mechanism such that when the panel along with the dogging operator are in the first position, the dogging assembly is configured to retain the latch in the retracted state and the dogging mechanism is concealed from user access, and the panel along with the dogging operator are configured to be slidable to a second position on the elongate housing wherein the lock dogging operator is disengaged from the dogging mechanism and user access is provided to the dogging mechanism.

2. The exit device of claim 1, wherein the elongate housing is configured to slidably receive the panel, and wherein when the panel is in the first position the dogging mechanism is covered by the panel, and when the panel is moved from the first position in a first direction relative to the elongate housing to the second position, the dogging mechanism is not covered by the panel.

3. The exit device of claim 1, wherein the lock dogging operator includes a stationary base, a lock hub, a rotatable shaft, and a dogging arm, the lock hub having a combination lock, the lock hub being rotatably attached to the stationary base, the stationary base being attached to the panel, the lock hub being connected to the rotatable shaft for rotation with the lock hub, and the dogging arm being fixedly attached to the rotatable shaft for rotation with the rotatable shaft, the dogging arm being drivably engaged with the dogging mechanism.

4. The exit device of claim 3, wherein the combination lock is a mechanical combination lock.

5. The exit device of claim 3, wherein the combination lock is an electromechanical lock.

6. The exit device of claim 3, wherein the lock hub, the rotatable shaft, and the dogging arm are configured for unitary rotation about a rotational axis relative to the stationary base when the combination lock is in an unlocked state.

7. The exit device of claim 6, wherein the unitary rotation is in a range of 90 degrees, plus or minus 5 degrees.

8. The exit device of claim 6, wherein the lock hub, the rotatable shaft, and the dogging arm are blocked from rotation about the rotational axis relative to the stationary base when the combination lock is in a locked state.

9. The exit device of claim 1, wherein the touch bar assembly is configured to prevent operation of the dogging mechanism to a dogged state until the touch bar is depressed relative to the elongate housing to a depressed position.

10. The exit device of claim 9, wherein:

the dogging mechanism includes a touch bar engagement plate and a dogging plate, the touch bar engagement plate having a first cam and a touch bar engagement arm, and the dogging plate having a dogging cam; and the dogging mechanism configured such that with the touch bar in the depressed position, the dogging mechanism is positioned in the dogged state by rotating the dogging plate about a first rotational axis, wherein the dogging cam of the dogging plate engages the first cam of the touch bar engagement plate, thereby rotating the touch bar engagement plate about a second rotational axis to cause the touch bar engagement arm to lock the touch bar down in the depressed position.

11. The exit device of claim 10, wherein the touch bar engagement plate is biased to an un-dogged position.

12. The exit device of claim 10, wherein the lock dogging operator includes a stationary base, a lock hub having a combination lock, a rotatable shaft, and a dogging arm, the lock hub being rotatably attached to the stationary base, the stationary base being attached to the panel, the lock hub being connected to the rotatable shaft for rotation with the lock hub, and the dogging arm being fixedly attached to the rotatable shaft for rotation with the rotatable shaft; and the dogging plate of the dogging mechanism having a pair of protrusions, a distal portion of the dogging arm of the lock dogging operator being positioned between the pair of protrusions of the dogging plate of the dogging mechanism, wherein with the touch bar depressed to a depressed position, a rotation of the lock hub in a first rotational direction effects a corresponding rotation of the dogging arm to rotate the dogging plate of the dogging mechanism to effect a state change of the dogging assembly from an un-dogged state to a dogged state.

13. The exit device of claim 12, wherein a rotation of the lock hub in a second rotational direction opposite the first rotational direction effects a corresponding rotation of the dogging arm to rotate the dogging plate of the dogging mechanism to effect a state change of the dogging assembly from a dogged state to an un-dogged state.

14. The exit device of claim 12, wherein the combination lock is a mechanical combination lock.

15. The exit device of claim 12, wherein the combination lock is an electromechanical lock.

16. A method for operating an exit device for a door, the method comprising:

providing an elongate housing configured to be mounted to an inside surface of the door;

a latch having an extended state and a retracted state;

a touch bar assembly attached to the elongate housing, the touch bar assembly including a touch bar that is movable relative to the elongate housing, and the touch bar assembly having a linkage that operably connects the touch bar to the latch to position the latch in the retracted state;

a panel slidably connected to the elongate housing; and a dogging assembly having a lock dogging operator and a dogging mechanism, the dogging mechanism being rotatably coupled to the elongate housing, and the lock dogging operator being mounted to the panel, the lock dogging operator being drivably engaged with the dogging mechanism when the panel is slidably translated along the elongate housing to a first position on the elongated housing, such that in the first position, the dogging assembly is configured to retain the latch in the retracted state and when the panel is in the first position the dogging mechanism is concealed from user access, the lock dogging operator including a lock hub having a lock;

operating the lock to achieve an unlocked state; and operating the lock hub to selectively change the operating state of the dogging mechanism from an un-dogged state to a dogged state or from the dogged state to the un-dogged state.

17. The exit device of claim 1, wherein the lock dogging operator includes a plurality of operator actuable inputs.

18. The exit device of claim 17, wherein the plurality of operator actuable inputs is a plurality of pushbuttons.

19. The exit device of claim 17, wherein the lock dogging operator is a combination lock.

20. The exit device of claim 1, wherein a first portion of the dogging assembly is carried by the panel, and a second portion of the dogging assembly is carried by the elongate housing.

21. The exit device of claim 1, wherein the wherein the dogging operator is spaced apart from the touch bar assembly along the elongated housing by a first distance when the dogging operator is in the first position and by a second distance when the dogging operator is in the second position, the second distance being unequal to the first distance.

22. An exit device for a door, the exit device comprising:

an elongate housing configured to be mounted to the door;

a latch having an extended state and a retracted state;

a touch bar assembly attached to the elongate housing, the touch bar assembly including a touch bar that is movable relative to the elongate housing, and the touch bar assembly having a linkage that operably connects the touch bar to the latch to position the latch in the retracted state;

a panel slidably connected to the elongate housing; and a dogging assembly having a lock dogging operator and a dogging linkage, the dogging linkage being rotatably coupled to the elongate housing, and the lock dogging operator being mountable carried by the panel, the panel along with the lock dogging operator being configured to be slidable from a first position on the elongate housing wherein the lock dogging operator is drivably engaged with the dogging linkage and wherein the dogging linkage is covered by the panel such that when the panel along with the lock dogging operator are in the first position, the dogging assembly is configured to retain the latch in the retracted state and the dogging mechanism is concealed from user access, and the panel along with the dogging operator are configured to be slidable to a second position on the elongate housing wherein the lock dogging operator is disengaged from the dogging linkage and the dogging linkage is not covered by the panel such that when the panel along with the dogging operator are in the second position, user access is provided to the dogging linkage.

* * * * *